US009321612B2

(12) United States Patent
Fargo et al.

(10) Patent No.: US 9,321,612 B2
(45) Date of Patent: Apr. 26, 2016

(54) ELEVATOR SYSTEM INCLUDING A 4:1 ROPING ARRANGEMENT

(75) Inventors: Richard N. Fargo, Plainville, CT (US); Frank J. Sclafani, New Milford, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 206 days.

(21) Appl. No.: 14/000,257

(22) PCT Filed: Feb. 23, 2011

(86) PCT No.: PCT/US2011/025841

§ 371 (c)(1),
(2), (4) Date: Aug. 19, 2013

(87) PCT Pub. No.: WO2012/115632

PCT Pub. Date: Aug. 30, 2012

(65) Prior Publication Data

US 2013/0327596 A1 Dec. 12, 2013

(51) Int. Cl.
*B66B 7/06* (2006.01)
*B66B 11/00* (2006.01)

(52) U.S. Cl.
CPC ..... *B66B 7/062* (2013.01); *B66B 11/008* (2013.01)

(58) Field of Classification Search
CPC ..... B66B 7/06; B66B 7/062; B66B 7/08; B66B 11/0065; B66B 11/008
USPC ..... 187/266
See application file for complete search history.

(56) References Cited

U.S. PATENT DOCUMENTS 6,247,557 B1 * 6/2001 Kobayashi et al. ..... 187/266
6,471,012 B2 10/2002 Faletto
6,655,500 B2 12/2003 Orrman et al.
7,077,241 B1 * 7/2006 Liebetrau et al. ..... 187/266

(Continued)

FOREIGN PATENT DOCUMENTS

CN 1149549 A 5/1997
CN 201002908 Y 1/2008

(Continued)

OTHER PUBLICATIONS

International Preliminary Report on Patentability for International application No. PCT/US2011/025841 dated Sep. 6, 2013.

(Continued)

*Primary Examiner* — William E Dondero
*Assistant Examiner* — Minh Truong
(74) *Attorney, Agent, or Firm* — Carlson, Gaskey & Olds

(57) ABSTRACT

An exemplary elevator system includes an elevator car. At least one guiderail guides movement of the elevator car. The guiderail has a length in a direction of movement of the elevator car and a depth generally perpendicular to the length. A plurality of flat belts are situated relative to the elevator car such that movement of the flat belts for causing movement of the elevator car is approximately four times a corresponding movement of the elevator car. A plurality of sheaves is situated for directing the flat belts as the belts at least partially wrap around the sheaves. The plurality of sheaves remains fixed near one end of the guide rail. The plurality of sheaves rotate about coaxially aligned axes and have a collective width along the axes that is no greater than the depth of the guiderail.

17 Claims, 3 Drawing Sheets

(56) References Cited

U.S. PATENT DOCUMENTS

| | | | | |
|---|---|---|---|---|
| 7,549,514 | B2 | 6/2009 | Heggli et al. | |
| 7,806,238 | B2 | 10/2010 | Fischer | |
| 2008/0121468 | A1 | 5/2008 | Fischer | |
| 2008/0164103 | A1 | 7/2008 | Fanion et al. | |
| 2011/0042169 | A1* | 2/2011 | Faletto | 187/256 |

FOREIGN PATENT DOCUMENTS

| | | | |
|---|---|---|---|
| CN | 201296591 | Y | 8/2009 |
| EP | 0588364 | A1 | 3/1994 |
| JP | 9124259 | A | 5/1997 |
| JP | 2003104657 | | 4/2003 |

OTHER PUBLICATIONS

International Search Report and Written Opinion of the International Searching Authority for International application No. PCT/US2011/025841 dated Nov. 15, 2011.

State Intellectual Property Office of People's Republic China, Search, Application No. 2011800682467 dated Dec. 22, 2014.

* cited by examiner

ELEVATOR SYSTEM INCLUDING A 4:1 ROPING ARRANGEMENT

BACKGROUND

Elevator systems have proven useful for carrying passengers between different levels in buildings. A variety of different elevator system configurations are available. Traction-based elevator systems include a roping arrangement that supports the weight of the elevator car and a counterweight. A machine drives a traction sheave that causes movement of the roping members to cause desired movement of the elevator car.

Various roping arrangements are known in the industry. The most straightforward is considered a 1:1 roping arrangement in which the movement of the roping members and the corresponding amount of movement of the elevator car is the same. In a 2:1 roping arrangement the roping members movement is twice as much as the corresponding movement of the elevator car. 4:1 roping arrangements have been proposed and include roping member movement that is approximately four times as much as the corresponding movement of the elevator car.

With the introduction of flat belt suspension members in place of round steel ropes, the ability to realize different roping arrangements is more complicated. The U.S. Patent Application Publication No. US 2008/0121468 shows one possible 4:1 roping arrangement that includes flat belts as the roping members. That document proposes an arrangement that includes a stacked arrangement of deflection sheaves on one side of the hoistway. One disadvantage associated with such an arrangement is that it requires more vertical space within the hoistway to accommodate the arrangement of those sheaves. Minimizing the amount of hoistway space required for an elevator system is an ongoing challenge within the elevator industry.

SUMMARY

An exemplary elevator system includes an elevator car. At least one guiderail guides movement of the elevator car. The guiderail has a length in a direction of movement of the elevator car and a depth generally perpendicular to the length. A plurality of flat belts are situated relative to the elevator car such that movement of the flat belts for causing movement of the elevator car is approximately four times a corresponding movement of the elevator car. A first plurality of sheaves is situated for directing the flat belts as the belts at least partially wrap around the first plurality of sheaves. The first plurality of sheaves remains fixed near one end of the guide rail. The first plurality of sheaves rotate about coaxially aligned axes and have a collective width along the axes that is no greater than the depth of the guiderail.

In another exemplary elevator system, the elevator system may additionally include a second plurality of sheaves. The first plurality of sheaves and the second plurality of sheaves may be each on an opposite side of the guiderail.

In another exemplary elevator system, the first plurality of sheaves may total two sheaves and the second plurality of sheaves may total two sheaves.

In another exemplary elevator system that includes the components of any of the foregoing elevator systems, the plurality of flat belts may total two belts.

In another exemplary elevator system that includes the components of any of the foregoing elevator systems, the collective width may be less than the depth of the guiderail.

In another exemplary elevator system that includes the components of any of the foregoing elevator systems, the collective width may be equal to the depth of the guiderail.

In another exemplary elevator system that includes the components of any of the foregoing elevator systems, the collective width may be between 60 mm and 75 mm.

In another exemplary elevator system that includes the components of any of the foregoing elevator systems, the flat belts may each have a width parallel to the width of the first plurality of sheaves, the belt width being between approximately 10 mm and 15 mm.

In another exemplary elevator system that includes the components of any of the foregoing elevator systems, the guiderail may be secured to a hoistway wall and the coaxial axes and the depth of the guiderail may be generally perpendicular to the hoistway wall.

In another exemplary elevator system that includes the components of any of the foregoing elevator systems, the elevator system may additionally or alternatively include a plurality of car sheaves supported on the elevator car for directing the flat belts across the elevator car. The plurality of car sheaves may rotate about car sheave axes that are perpendicular to the coaxially aligned axes of the first plurality of sheaves.

In another exemplary elevator system that includes the components of any of the foregoing elevator systems, the plurality of car sheaves may be positioned beneath the first plurality of sheaves so that a section of each of the flat belts between the first plurality of sheaves and the plurality of car sheaves is oriented vertically straight and parallel to the direction of elevator car movement.

In another exemplary elevator system that includes the components of any of the foregoing elevator systems, the elevator system may additionally or alternatively include a counterweight associated with the elevator car, the flat belts suspending the elevator car and the counterweight.

In another exemplary elevator system that includes the components of any of the foregoing elevator systems, the elevator system may additionally or alternatively include a plurality of counterweight sheaves supported for movement with the counterweight, at least a first one of the counterweight sheaves being closer to one side of the counterweight than a second one of the counterweight sheaves to thereby suspend the counterweight in a manner that is substantially centered about a center of gravity of the counterweight.

In another exemplary elevator system that includes the components of any of the foregoing elevator systems, the first and second counterweight sheaves may be aligned with each other and with a single vertical plane that is oriented at an oblique angle relative to the one side of the counterweight.

In another exemplary elevator system that includes the components of any of the foregoing elevator systems, the elevator system may include five counterweight sheaves that are supported on the counterweight for movement with the counterweight within the hoistway. Further, all five counterweight sheaves may be aligned within the single vertical plane.

In another exemplary elevator system that includes the components of any of the foregoing elevator systems, the plurality of belts may follow one path from one end of the belts, beneath the elevator car and to a traction sheave. Further, a first one of the belts may follow a first path from the traction sheave, about a plurality of deflection sheaves supported on a counterweight and to another end of the first one of the belts whereas a second one of the belts may follow a second, different path from the traction sheave, about a plurality of sheaves supported on a counterweight and to another end of the second one of the belts.

In another exemplary elevator system that includes the components of any of the foregoing elevator systems, the plurality of sheaves supported on the counterweight may all be aligned with each other and with a single vertical plane.

The various features and advantages of a disclosed example embodiment will become apparent to those skilled in the art from the following detailed description. The drawings that accompany the detailed description can be briefly described as follows.

DETAILED DESCRIPTION

Figure 1:
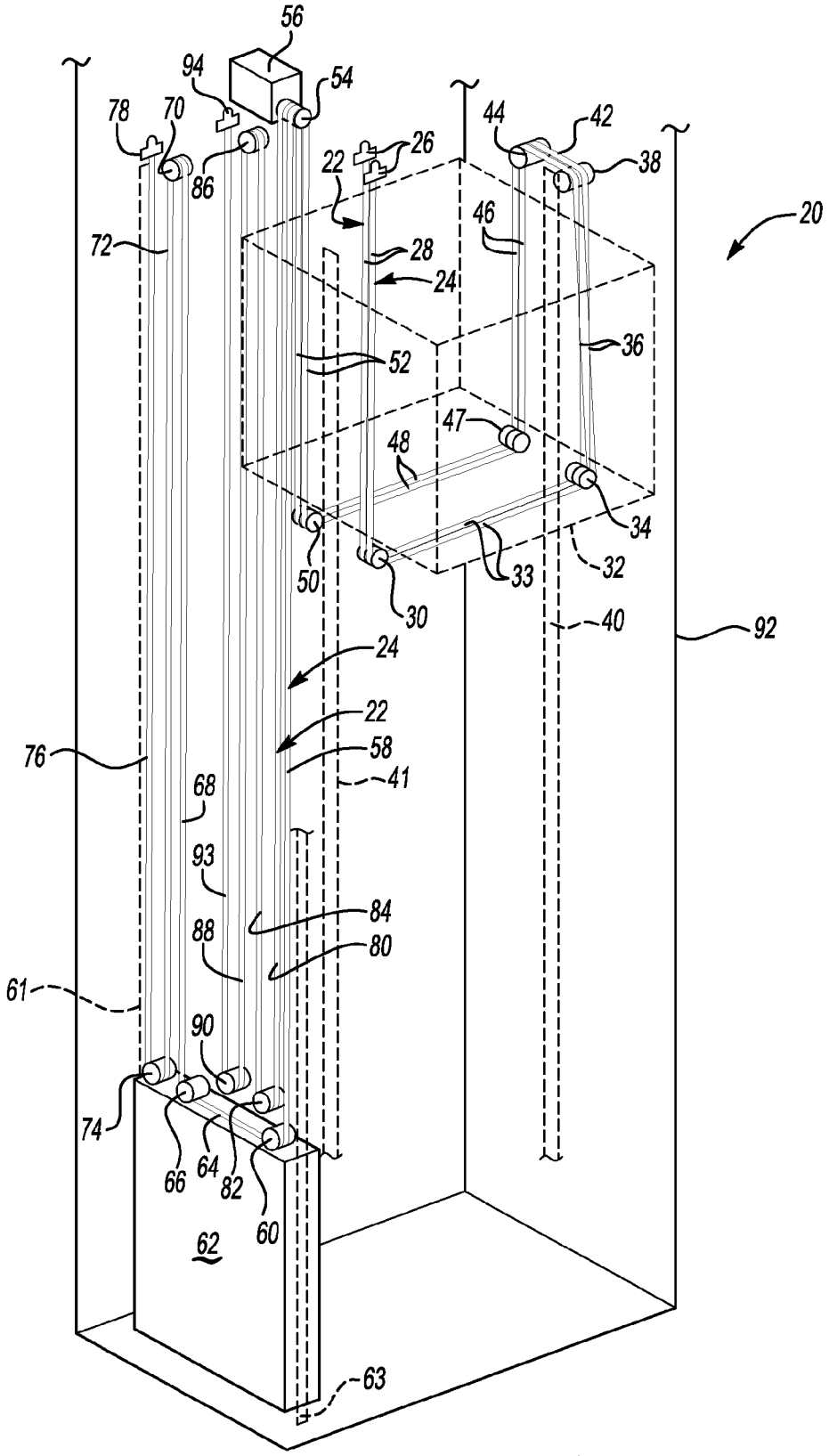
FIG. 1 diagrammatically illustrates selected portions of an elevator system including a roping arrangement designed according to an embodiment of this invention.

FIG. 1 illustrates selected portions of an elevator system 20 that includes a car 32 and a counterweight 62 both of which are configured to move vertically (in opposite directions) in a hoistway 92 (part of which is shown as being removed in FIG. 1 for ease of viewing purposes). The car 32 moves along car guide rails 40, 41. Similarly, the counterweight 62 moves along counterweight guide rails 61, 63. Flat belts 22 and 24 are situated in a 4:1 roping arrangement. The arrangement of the flat belts 22 and 24 and the manner in which they are directed about a path of movement by the sheaves results in movement of the belts 22 and 24 for causing movement of the elevator car 32 that is approximately four times the corresponding movement of the elevator car 32.

One end of each of the belts 22 and 24 is secured near a top of a hoistway by a respective termination 26. First portions 28 of the belts extend vertically downward from the terminations 26 to sheaves 30 that direct the belts underneath the elevator car 32. Second portions of the belts 33 extend beneath the elevator car 32 between the sheaves 30 and sheaves 34. Third portions 36 of the belts 22 and 24 extend vertically upward along one side of the elevator car 32.

Sheaves 38 and 44 are situated in fixed vertical positions near a top of a guiderail 40. The third portions 36 from the sheaves 34 extend to sheaves 38. Fourth portions 42 of the belts 22 and 24 extend between the sheaves 38 and sheaves 44. Fifth portions 46 of the belts extend vertically downward to sheaves 47 supported on the elevator car 32. Sixth portions 48 of the belts extend between the sheaves 47 and sheaves 50, which are also supported on the elevator car 32.

Seventh portions 52 of the belts 22 and 24 extend vertically upward from the sheaves 50 to a traction sheave 54 that is driven by a machine 56. After partially wrapping about the traction sheave 54, the belts 22 and 24 include vertically dropping eighth portions 58 and 80 that extend downward toward the counterweight 62. At this point, it may be noted that the first portions 28 and the seventh portions 52 of the belts 22 and 24 follow similar paths (i.e., parallel and side-by-side to each other) between the car 32 and either: (i) the respective terminations 26 (first portions 28); or (ii) the traction sheave 54 (seventh portions 52). On the other side of the traction sheave 54, however, the belts 22 and 24 do not follow the same path. The illustrated example includes a unique arrangement of belts and sheaves on the counterweight side of the hoistway 92 to allow for the counterweight to move very close to the top of the hoistway 92 without introducing significant draw angles in the belts. This arrangement minimizes or eliminates any misalignment of the belts and the sheaves on the counterweight side of the hoistway 92.

The eighth portion 58 of belt 24 in this example extends down from the traction sheave 54 to a sheave 60 supported on the counterweight 62. A lateral portion 64 of the belt 24 extends between the sheave 60 and a sheave 66 also supported on the counterweight 62. A vertically upwardly extending ninth portion 68 of the belt 24 is between the sheave 66 and a sheave 70 supported near the top of the hoistway 92 above the counterweight 62. A tenth portion 72 of the belt 24 extends downward to a sheave 74 supported on the counterweight 62. A final, eleventh portion 76 of the belt 24 extends vertically between the sheave 74 and a termination 78 that remains in a fixed position, which is near a top of the hoistway 92 in this example.

The belt 22 follows a different path in which its eighth portion 80 extends down from the traction sheave 54 to a sheave 82 supported on the counterweight 62. Thereafter, rather than having a lateral portion corresponding to the lateral portion 64 of belt 24, the belt 22 wraps partially around the sheave 82 such that a ninth portion 84 extends vertically upward to a sheave 86 that is supported near a top of the hoistway 92. A tenth portion 88 of belt 22 extends down from the sheave 86 to a sheave 90 supported on the counterweight 62. The belt 22 includes a final, eleventh portion 93 that extends between the sheave 90 and a termination 94 supported in a fixed position near the top of the hoistway 92.

For simplicity of illustration, the manner in which the illustrated sheaves are supported underneath the elevator car 32, on the counterweight 62 or near the top of the hoistway 92 is not shown. Those skilled in the art, who have the benefit of this description, will realize how to support the sheaves in the corresponding locations to meet their particular needs. Similarly, the manner in which the terminations and the machine are supported near the top of the hoistway 92 is not shown.

Figure 2:
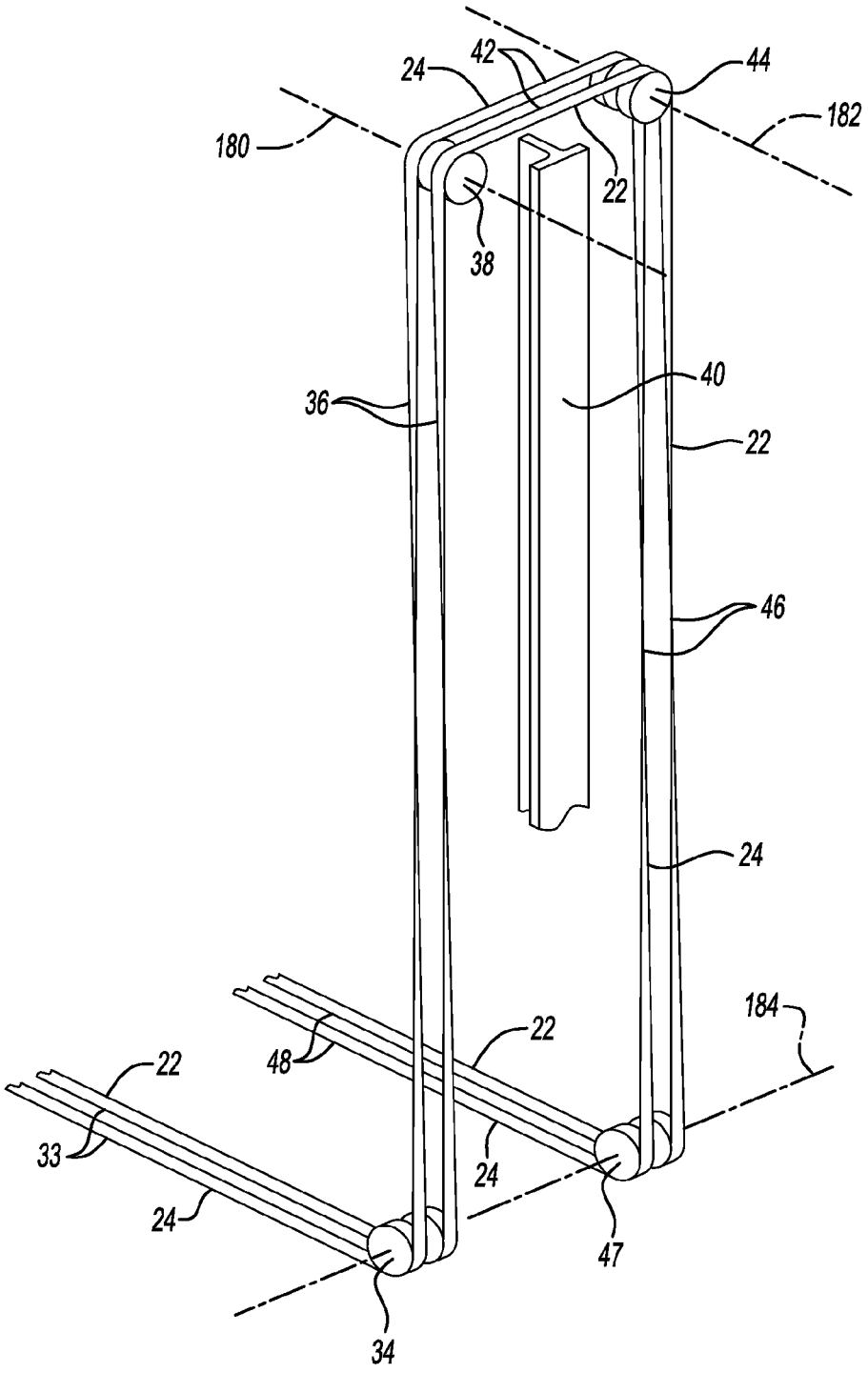
FIG. 2 diagrammatically illustrates selected features of the example of FIG. 1.

One feature of the example arrangement is shown in FIG. 2. The sheaves 38 and 44 situated near a top of the guiderail 40 are arranged parallel to each other and perpendicular to the sheaves 34 and 47, which are parallel to each other. The sheaves 38 in this example comprise two sheaves that have coaxially aligned axes of rotation schematically shown at 180. The sheaves 44 also comprise two sheaves that rotate about coaxially aligned axes schematically shown at 182. The sheaves 34 and 47 each comprise two sheaves and they all rotate coaxially about a single axis schematically shown at 184. The arrangement of the sheaves 38, 44, 34 and 47 allows for a nearly straight vertical drop of the sections 36 and 46 of the belts 22 and 24. A nearly straight vertical drop in this example includes the portions 36 and 46 being parallel to a length of the guiderail 40 (i.e., a direction of movement of the elevator car 32). The perpendicular orientation of the axis 184 relative to the axes 180 and 182 results in a twist in the flat belts 22 and 24 along each of the portions 36 and 46. Such an arrangement minimizes the amount of draw on the belts and facilitates better tracking of the belts on the sheaves.

Figure 3:
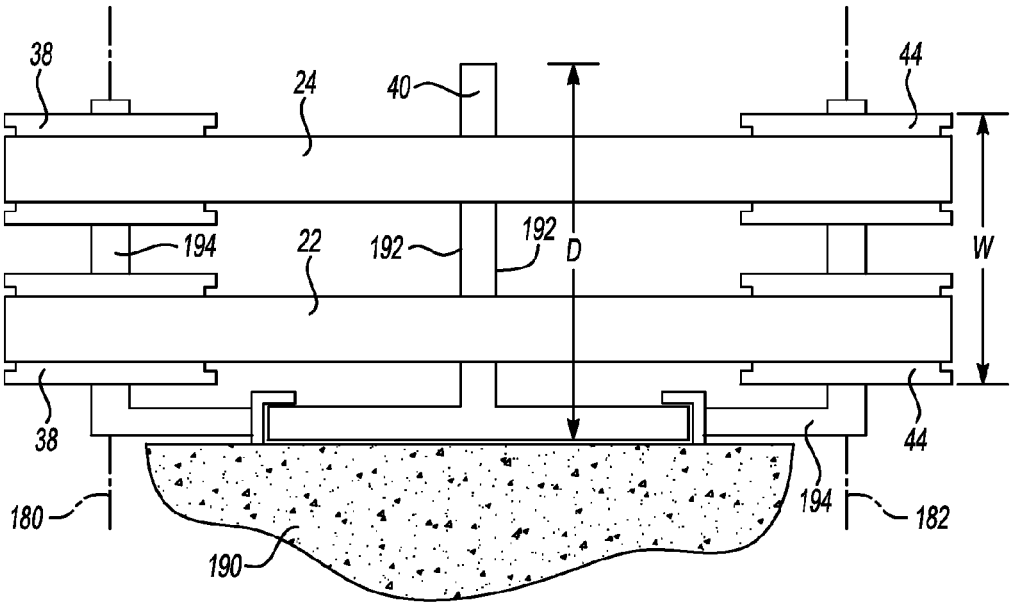
FIG. 3 diagrammatically illustrates another selected feature of the example embodiment.

Another feature of the illustrated example is shown in FIG. 3, which is an elevational view from above the guiderail 40 in this example. The guiderail 40 is secured to a hoistway wall 190 using known brackets, for example. A portion of the guiderail 40 includes guiding surfaces 192 along which elevator guide members travel as the elevator car 32 moves vertically responsive to movement of the belts 22 and 24 caused by the machine 56 and the traction sheave 54. The guiderail 40 has a longitudinal length dimension that extends vertically in the hoistway (i.e., into the page in FIG. 3) and a depth dimension D that is perpendicular to the length of the guiderail 40. In the illustrated example, the depth dimension is measured in a direction generally perpendicular to a surface of the hoistway wall 190.

The sheaves 38 and 44 each have a collective width along their respective coaxially aligned axes of rotation shown at w in FIG. 3. The collective width w is no greater than the depth D of the guiderail 40. This arrangement allows for conveniently fitting the sheaves 38 and 40 within the limited space between the elevator car 32 and the hoistway wall 190. In one example, the depth D is in a range between 60 and 75 mm. The collective width w is within the same range. In one example, the collective width w equals the depth D.

In the illustrated example, the sheaves 38 are shown as two individual wheels coaxially aligned along the axis of rotation 180. In another example, the sheaves 38 are formed as two distinct belt-guiding grooves on a single cylinder or wheel. For purposes of this description, either type of configuration is considered a plurality of sheaves that are coaxially aligned (i.e., either configuration directs more than one belt 22, 24 along the desired roping path and each belt can be considered to engage its own sheave). The same is true regarding the sheaves 44 in the example of FIG. 3, as well as sheaves 30, 34, 47, 50, 54, 60, 66, 70, and 74 shown in FIG. 1.

The example of FIG. 3 includes a mounting structure 194 that supports the axes 180, 182 of the sheaves 38 and 44 in a fixed position relative to the guiderail 40. In this example, the mounting structure 194 is at least partially supported by the guiderail 40.

Figure 4:
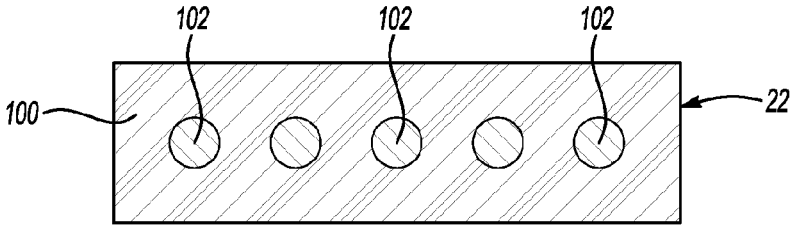
FIG. 4 is a cross-sectional illustration of an example flat belt.

One way in which the collective width w is kept within the depth dimension D is by using narrow belts 22 and 24. FIG. 4 is a cross-sectional illustration of an example belt 22. A polymer jacket 100 surrounds a plurality of tension members 102, which comprise steel cords in one example. The example belt 22 of FIG. 4 includes five tension members 102. Another example includes four tension members 102. The foregoing discussion of possible structures for belt 22 applies equally to belt 24.

Using fewer tension members and narrower belts compared to elevator systems that include up to twelve such tension members in a flat belt facilitates fitting all of the belts required for supporting the load of the elevator car 32 and counterweight 62 and directing them about sheaves within the space occupied by the depth D of the guiderail 40. The 4:1 roping arrangement reduces the load supported by each belt and smaller belts can be used.

Figure 5:
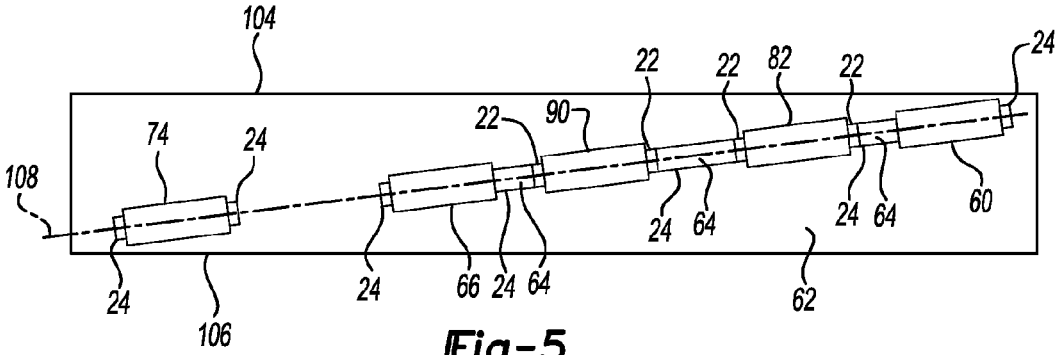
FIG. 5 schematically illustrates another selected feature of the example embodiment.

FIG. 5 illustrates another feature of the example embodiment. The sheaves 60, 66, 74, 82 and 90 are situated relative to the counterweight 62 to achieve a balanced suspension of the counterweight 62 about its center of gravity. In this example, the sheave 60 is positioned closer to one side 104 of the counterweight 62 while the sheave 74 is positioned closer to an opposite side 106. The path followed by the lateral portion 64 of the belt 24 between the sheaves 60 and 66 is only partially visible in FIG. 5 because the sheaves 82 and 90 are also shown. As can be appreciated from the illustration, each of the sheaves is aligned within a single vertical plane, which is shown schematically at 108, at an oblique angle relative to the sides 104 and 106 of the counterweight 62. Distributing the positions of the sheaves about the counterweight in this manner allows for suspending the counterweight 62 about its center of gravity in a direction between the sides 104 and 106 and in a perpendicular direction (e.g., from right to left according to the drawing). Such an arrangement provides operating efficiencies with respect to guiding the counterweight 62 along a path of vertical movement.

Additionally, as mentioned above, the arrangement of the sheaves on the counterweight side of the hoistway 92 including the sheaves supported on the counterweight 62 allows for maintaining vertical alignment of the portions of the belts on that side of the hoistway in a way that minimizes any draw angles. This minimizes or eliminates any misalignment and allows the counterweight 62 to move very near the top of the hoistway 92. The further upward that the counterweight 62 moves, the larger the resulting draw angles would be if there were any misalignment. The balanced and co-planar alignment of the sheaves on the counterweight side avoids large draw angles.

The illustrated example and the features discussed above provide a 4:1 roping arrangement within an elevator system that minimizes space requirements, provides improved belt tracking along a desired roping path and facilitates efficiencies in elevator system operation. For example, the ability to utilize a 4:1 roping arrangement allows for using a smaller machine 56, which provides savings in equipment cost and power consumption. The smaller belts 22 and 24 can be directed about the roping path using relatively small and inexpensive sheaves, which provides additional cost savings. A smaller machine 56 and smaller belts 22 and 24 can be used because a 4:1 roping arrangement reduces the load supported by the belts and the amount of torque required for moving the elevator car 32.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

an elevator car;

at least one guiderail that guides movement of the elevator car, the guiderail having a length in a direction of movement of the elevator car and a depth generally perpendicular to the length;

a plurality of flat belts situated relative to the elevator car such that movement of the flat belts for causing movement of the elevator car is approximately four times a corresponding movement of the elevator car; and a first plurality of sheaves that the flat belts at least partially wrap around, the first plurality of sheaves remaining fixed near one end of the guiderail, the first plurality of sheaves rotating about coaxially aligned axes and having a collective width along the axes that is no greater than the depth of the guiderail.

2. The elevator system of claim 1, comprising a second plurality of sheaves and wherein the first plurality of sheaves and the second plurality of sheaves are each on an opposite side of the guiderail.

3. The elevator system of claim 2, wherein the first plurality of sheaves totals two sheaves and the second plurality of sheaves totals two sheaves.

4. The elevator system of claim 1, wherein the plurality of flat belts totals two belts.

5. The elevator system of claim 1, wherein the collective width is less than the depth of the guiderail.

6. The elevator system of claim 1, wherein the collective width is equal to the depth of the guiderail.

7. The elevator system of claim 1, wherein the collective width is between 60 mm and 75 mm.

8. The elevator system of claim 1, wherein the flat belts each have a width parallel to the width of the first plurality of sheaves, the belt width being between approximately 10 mm and 15 mm.

9. The elevator system of claim 1, wherein the guiderail is secured to a hoistway wall and the coaxial axes and the depth of the guiderail are generally perpendicular to the hoistway wall.

10. The elevator system of claim 1, comprising a plurality of car sheaves supported on the elevator car for directing the flat belts across the elevator car and wherein the plurality of car sheaves rotate about car sheave axes that are perpendicular to the coaxially aligned axes of the first plurality of sheaves.

11. The elevator system of claim 10, wherein the plurality of car sheaves are positioned beneath the first plurality of sheaves so that a section of each of the flat belts between the first plurality of sheaves and the plurality of car sheaves is oriented vertically straight and parallel to the direction of elevator car movement.

12. The elevator system of claim 1, comprising a counterweight associated with the elevator car, the flat belts suspending the elevator car and the counterweight.

13. The elevator system of claim 12, comprising a plurality of counterweight sheaves supported for movement with the counterweight, at least a first one of the counterweight sheaves being closer to one side of the counterweight than a second one of the counterweight sheaves.

14. The elevator system of claim 13, wherein the first and second counterweight sheaves are aligned with each other and with a single vertical plane that is oriented at an oblique angle relative to the one side of the counterweight.

15. The elevator system of claim 14, comprising five counterweight sheaves that are supported on the counterweight for movement with the counterweight within the hoistway and wherein all five counterweight sheaves are aligned within the single vertical plane.

16. The elevator system of claim 1, wherein the plurality of belts follow one path from one end of the belts, beneath the elevator car and to a traction sheave;

a first one of the belts follows a first path from the traction sheave, about a plurality of deflection sheaves supported on a counterweight and to another end of the first one of the belts; and a second one of the belts follows a second, different path from the traction sheave, about a plurality of sheaves supported on a counterweight and to another end of the second one of the belts.

17. The elevator system of claim 16, wherein the plurality of sheaves supported on the counterweight are all aligned with each other and with a single vertical plane.

* * * * *